US006899028B2

(12) United States Patent
Arai et al.

(10) Patent No.: US 6,899,028 B2
(45) Date of Patent: May 31, 2005

(54) CONTAINER

(75) Inventors: Masakatsu Arai, Ibaraki-ken (JP); Takahiro Wakayama, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/347,298

(22) Filed: Jan. 21, 2003

(65) Prior Publication Data

US 2003/0101883 A1 Jun. 5, 2003

Related U.S. Application Data

(63) Continuation-in-part of application No. 09/732,907, filed on Dec. 11, 2000, now Pat. No. 6,578,482.

(30) Foreign Application Priority Data

Dec. 15, 1999 (JP) ..... 11-355789

(51) Int. Cl.[7] ..... B41L 27/00

(52) U.S. Cl. ..... 101/335; 101/364; 101/114; 101/366; 101/123; 101/124; 220/656; 220/659; 347/85; 347/86; 347/617; 347/621; 347/628; 347/211; 347/255

(58) Field of Search ..... 101/364, 114, 101/335, 366, 123, 124; 220/656, 659; 222/327; 347/85, 86, 617, 621, 628, 630–31, 211, 255

(56) References Cited

U.S. PATENT DOCUMENTS

| | | | | |
|---|---|---|---|---|
| 3,884,396 A | * | 5/1975 | Gordon et al. | 222/327 |
| 4,169,547 A | * | 10/1979 | Newell | 222/386 |
| 4,785,931 A | | 11/1988 | Weir et al. | |
| 4,834,268 A | * | 5/1989 | Keller | 222/327 |
| 5,126,177 A | | 6/1992 | Stenger | |
| 5,275,100 A | * | 1/1994 | Harpold et al. | 101/335 |
| 5,301,839 A | | 4/1994 | Eierle et al. | |
| 5,398,847 A | * | 3/1995 | Hasegawa | 222/41 |
| 5,411,182 A | * | 5/1995 | Marte et al. | 222/386 |
| 5,535,924 A | * | 7/1996 | Nilsson et al. | 222/153.06 |
| 5,680,967 A | | 10/1997 | Dang et al. | |
| 5,881,928 A | | 3/1999 | Register et al. | |
| 6,056,164 A | * | 5/2000 | Wakayama | 222/327 |
| 6,192,797 B1 | | 2/2001 | Rea et al. | |
| 6,223,941 B1 | | 5/2001 | Nealey | |
| 6,283,337 B1 | * | 9/2001 | Nakamura et al. | 222/402.13 |
| 6,302,574 B1 | | 10/2001 | Chan | |

FOREIGN PATENT DOCUMENTS

| | | |
|---|---|---|
| DE | 44 31 181 C1 | 12/1995 |
| EP | 0 228 556 | 7/1987 |
| EP | 592741 | 4/1994 |
| FR | 2 243 598 | 9/1973 |
| GB | 2 010 978 A | 7/1979 |

* cited by examiner

*Primary Examiner*—Andrew H. Hirshfeld
*Assistant Examiner*—Andrea Hence Evans
(74) *Attorney, Agent, or Firm*—Kendrew H. Colton; Fitch Even Tabin & Flannery

(57) ABSTRACT

A container is provided which comprises a cylindrical main body having an end wall at an end thereof; an outlet projecting from an outer surface of the end wall for allowing a content to be supplied; and a protecting member disposed on the outer surface of the end wall so that it surrounds the outlet and defines a groove portion between the outlet and the protecting member. The protecting member is preferably a continuous or discontinuous annular projection. A conduit of a pump can be coupled to the groove portion by engaging an inner circumferential surface of the protecting member with an outer circumferential surface of the conduit, or by engaging an outer circumferential surface of the outlet with an inner circumferential surface of the conduit.

10 Claims, 8 Drawing Sheets

CONTAINER

CROSS-REFERENCES TO RELATED APPLICATIONS

This application is a Continuation-in-part of U.S. patent application Ser. No. 09/732,907 filed Dec. 11, 2000 now U.S. Pat. No. 6,578,482.

BACKGROUND OF THE INVENTION

1. Field of the Invention

The present invention relates to a container useful for storing and feeding liquid, and particularly relates to a variable volume container whose volume changes as a piston member fitted therein moves.

2. Description of Related Art

The variable volume container of this type is employed for example as a container for ink used in stencil printing. In stencil printing machines, ink is supplied to the inner side of a cylindrical printing drum, and the ink is transferred onto a printing sheet through a perforated stencil sheet wound around the outer side of the printing drum. The ink container is normally a cartridge type container detachably mounted to the printing drum, and printing ink is fed from the ink container into the printing drum.

FIG. 15 shows how the ink container 1 is mounted into the printing drum 2. The printing drum 2 is formed to have a cylindrical shape with an ink-permeable circumferential surface which rotates around the central axis of the printing drum. The ink fed into the printing drum 2 from the ink container 1 is pressed toward the outer side of the printing drum 2 by a squeegee roller 3 which rotates as it is in contact with the inner circumferential surface of the printing drum 2. A doctor roller 4 is provided obliquely over and parallel to the squeegee roller 3 with a small gap therebetween, and thereby an ink hold portion P is formed at the valley portion formed between the squeegee roller 3 and the doctor roller 4.

An ink pump 5 is provided in the printing drum 2 to supply printing ink from the ink container 1. The ink pump 5 includes a suction conduit 5*a* detachably coupled to the outlet 1*a* of the ink container 1, and an outlet conduit 5*b* in communication with an ink distribution tube 6 supported parallel to and above the ink hold portion P. Ink sucked and supplied from the ink container 1 using the ink pump 5 is supplied to the ink hold portion P through the outlet conduit 5*b* and the ink distribution tube 6.

The ink container 1 is formed into a cylinder/piston type container, and the outlet 1*a* is formed at an end wall 1*c* that blocks a front end of the cylinder 1*b* (the right end in FIG. 15). The back end of the cylinder 1*b* (the left end in FIG. 15) is sealed by a piston member 1*d* slidably fitted into the cylinder 1*b*, and thus an ink storage chamber 1*e* is formed between the end wall 1*c* and the piston member 1*d*. The amount of ink contained in the ink storage chamber 1*e* is reduced as the ink is sucked using the ink pump 5, and as a result the piston member 1*d* moves toward the front end of the cylinder 1*b* in the sealed state. The ink container 1 having such a structure is distributed in the market as it has its outlet 1*a* sealed with a cap 1*f* as shown in FIG. 16, and when the ink container 1 is used, the outlet 1*a* removed of the cap 1*f* is inserted into the suction conduit 5*a* of the ink pump 5. As shown by the double dotted chain line in FIG. 16, the back end of the cylinder 1*b* (the upper end in FIG. 16) is provided with a simple cover 7 having an opening, in order to prevent the piston member 1*d* from coming out.

However, if the ink container 1 is transported or stored in a distribution channel with the cap 1*f* facing upward, ink could leak from a gap between the piston member 1*d* and the inner wall of the cylinder 1*b*, or the piston member 1*d* could go down by the weight of ink, causing air to enter the ink storage chamber 1*e* from a gap between the outlet 1*a* and the cap 1*f* and mix into the ink. Therefore, the cap side of the container 1 is preferably faced downward as shown in FIG. 16, in other words, the ink container 1 is preferably placed upside down in packing into a box or in display.

As can be seen from FIG. 16, however, the outlet 1*a* of the ink container 1 is formed to have a diameter smaller than the diameter of the cylinder 1*b*. As a result, the following disadvantages are encountered if the container 1 is placed with the smaller-sized outlet 1*a* being faced downward.

(1) This smaller-sized outlet 1*a* or the cap 1*f* has to support the entire load of the ink container 1 and the content thereof, and therefore the ink container 1 becomes unstable, and can be easily turned over even by slight vibration.

(2) At the time of packaging, transporting and unloading, if the container 1 is impacted or dropped, impact force could be concentrated at the outlet 1*a*, causing damage to the outlet 1*a* and thereby causing leakage of ink from the cylinder 1*b*.

In recent years, in order to increase the storage amount of ink, there is a demand that diameter of the cylinder 1*b* is enlarged as far as the cylinder 1*b* is accommodated in an attachment space of the printing drum 2. In this case, the outlet 1*a* would be even smaller as compared to the enlarged cylinder 1*b*, which makes the disadvantages even more serious.

Furthermore, stencil printing inks recently tend to be lowered in viscosity in order to improve drying and reduce loads on printing machines upon printing. In this case, the diameter of the outlet 1*a* should be kept smaller in order to prevent inks from flowing out of the container 1 when it is fitted in or removed from the suction conduit 5*a*. However, this also makes the above-mentioned disadvantages more serious.

It is an object of the present invention to provide a variable volume container which has an improved structure in the vicinity of the outlet and is capable of stably holding the outlet facing downward even if the cylinder of the container is enlarged in diameter.

It is another object of the present invention to provide a container which has an improved structure in the vicinity of the outlet so that the outlet is protected against impact force.

BRIEF SUMMARY OF THE INVENTION

According to the present invention, the above-described object is achieved by a variable volume container comprising a cylindrical main body having an end wall at an end thereof; an outlet projecting from an outer surface of said end wall for allowing a content to be supplied; a piston member fitted into said main body sealingly and slidably in an axial direction of said main body for defining a variable volume storage chamber between itself and said end wall; a cap member detachably mounted to said outlet; and an impact resisting reinforcement disposed at said end wall.

In this structure, the storage chamber is sealed by the cap member that is attached to the outlet projecting from the end wall. If the container is placed upside down with the outlet facing downward in the sealed state, the entire load of the container including the weight of the content acts upon the outlet. If impact in a vertical direction is applied to the container in this state, impact force concentrates at the outlet, particularly at the root portion of the outlet. However, since the impact resisting reinforcement is provided at the end wall from which the outlet projects, the root portion of the outlet is protected by the impact resisting reinforcement and is prevented from being damaged.

The impact resisting reinforcement may be a part of said end wall having a thickness gradually increased toward said outlet. This thickness increasing part is thickest and strongest at the outlet, and therefore improves the strength of the root portion of the outlet to effectively protect the root portion against impact and prevent the outlet from being damaged.

In addition, the impact resisting reinforcement may be formed as a rib shaped projection disposed on an outside surface, an inside surface, or both outside and inside surfaces of said end wall. The rib shaped projection reinforces the end wall provided with the outlet, and protects the root portion of the outlet, so that the outlet will not be damaged.

The rib shaped projection is preferably disposed in contact with an outer periphery of a projecting part of the outlet. In this case, the outer periphery of the projecting part of the outlet is supported by the rib shaped projection, and thus the outlet will not be deformed by bending or buckling, or damaged even when impact is applied thereto.

The rib shaped projection preferably extends beyond a line connecting a periphery of a head of said cap member mounted to said outlet and a periphery of said end wall. When the height of the rib shaped projection is at least beyond the line connecting the periphery of the head of the cap member and the periphery of the end wall, the impact applied to the outlet can be avoided or alleviated.

Furthermore, it is preferred that the rib shaped projection is gradually broadened toward the end wall, so that a corner portion formed between the rib shaped projection and the end wall is rounded. The corner portion having such a circular arc surface can prevent stress from concentrating at the root portion of the rib shaped projection. Therefore, the effect of the rib shaped projection to reinforce the end wall can further be improved.

Furthermore, preferably, the cap member has a head with an expanded diameter in a direction perpendicular to an axis of said cylindrical main body and a larger area than said outlet, and has a leg portion which projects from said head and is in abutment against said end wall. In this case, the main body is supported by the surface of the expanded head of the cap member and thus is placed stably. Also, any impact applied to the head is allowed to escape to the end wall through the leg portion, and thus the impact directly applied upon the outlet can be alleviated so that the outlet is prevented from being damaged.

In addition, in each of the variable volume containers described above, the storage chamber can store a high viscosity material, such as printing ink for use in stencil printing. In this case, the variable volume containers can be used as an ink container received in a stencil printing machine. When the ink containers are placed upside down with the outlet at the lower side in packaging/transport, the outlet can be prevented from being damaged during the transport, so that ink will not leak.

According to a preferred embodiment of the present invention, the rib shaped projection disposed on an outside or outer surface of said end wall may be formed as a protecting member that surrounds the outlet, and may be, for example, a continuous or discontinuous annular projection which is located apart from the outer periphery of the projecting part of the outlet. This structure is particularly useful for a container with a small-sized outlet, which stores a liquid low in viscosity, including a low viscosity ink for stencil printing. The protecting member also protects the outlet from impact in the same manner as mentioned above, and defines a groove portion between the outlet and the protecting member for connection with a conduit of a pump that sucks a content from the container. In addition, even if the ink flows out of the outlet upon installation or removal of the container from the printing machine, the protecting member that surrounds the outlet will prevent the ink from flowing out of the protecing member and prevent the printing machine or operators from being stained with the ink.

Thus, according to another aspect of the present invention, there is provided a container comprising a cylindrical main body having an end wall at an end thereof; an outlet projecting from an outer surface of said end wall for allowing a content to be supplied; and a protecting member which is disposed on the outer surface of said end wall to surround said outlet and define a groove portion between said outlet and said protecting member for connection with a conduit.

According to still another aspect of the present invention, there is provided a stencil printing apparatus comprising a printing drum, the above mentioned container that contains a stencil printing ink, and an ink pump which has a conduit coupled to the groove portion defined between said outlet and said protecting member.

According to yet still another aspect of the present invention, there is provided a method for coupling a container for stencil printing ink to a printing apparatus having an ink pump with a conduit, which comprises providing the above mentioned container, and coupling said conduit to the groove portion defined between said outlet and said protecting member.

BRIEF DESCRIPTION OF THE SEVERAL VIEWS OF THE DRAWING

Embodiments of the present invention will be now described in detail in conjunction with the accompanying drawings, in which.

DETAILED DESCRIPTION OF THE INVENTION

Figure 1:
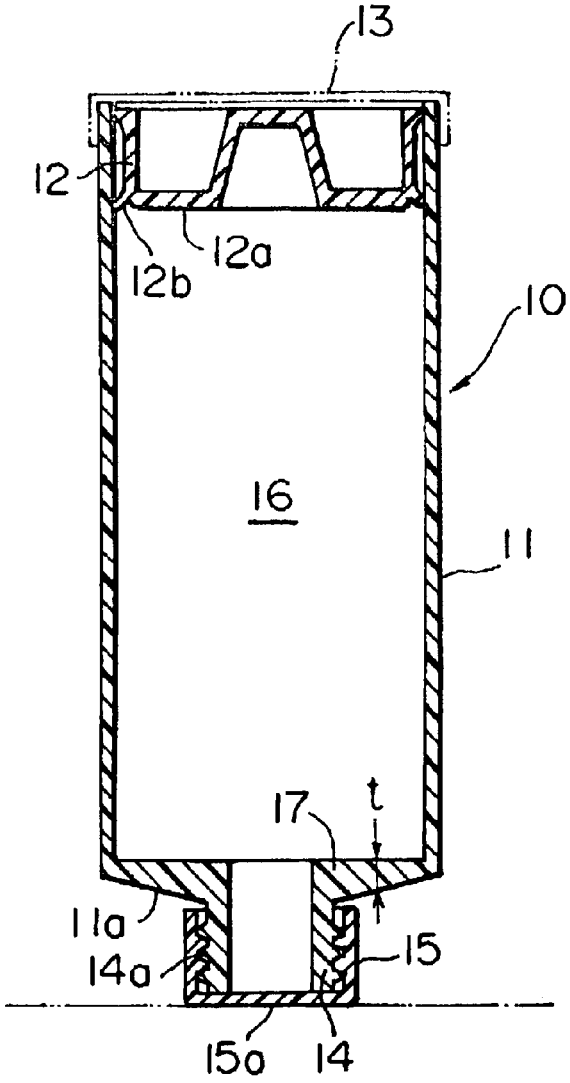
FIG. 1 is a vertical sectional view of a variable volume container according to one embodiment of the present invention.

FIG. 1 is a vertical sectional view of a variable volume container 10 according to one embodiment of the present invention in which the container 10 is placed upside down. The container 10 is formed as a piston/cylinder type container, and basically includes an approximately cylindrical main body 11, and a piston member 12 fitted in the main body 11 and provided slidably in the axial direction of the main body. The main body 11 has one end thereof (the lower end in FIG. 1) closed with an end wall 11*a*, and the other end thereof (the upper end in FIG. 1) opened. A tail cap 13 having an opening is detachably fitted to the open end. The end wall 11*a* includes an outlet 14 projecting outward at the central part thereof, and a cap 15 as a cap member is detachably screwed to a screw portion 14*a* formed on the outer periphery of the outlet 14. The cap 15 has a head 15*a* with a flat surface perpendicular to the axis of the main body 11.

Meanwhile, the piston member 12 is basically formed to have an approximately cylindrical shape having a slightly smaller outer diameter than the inner diameter of the main body 11. One end of the piston member 12 (the lower end in FIG. 1) is provided with an end wall 12*a*, and the other end is opened (the upper end in FIG. 1). The end wall 12*a* has a reinforced structure with its central part recessed toward the other end, and is provided at its outer periphery with an annular scraping portion 12*b* which slightly expands and projects like a funnel. The scraping portion 12*b* has a top end portion press-contacted to the inner circumferential surface of the main body 11 so as to maintain a sealed state between the main body 11 and the piston member 12. Thus, a variable volume storage chamber 16 in which a content is stored is defined between the end wall 1*a* and the piston member 12 in the main body 11.

Herein, the end wall 11*a* is formed to have a thickness t gradually increasing from the periphery of the end wall 11*a* toward the outlet 14, and the part 17 in which the thickness is varied is formed to function as an impact resisting reinforcement.

The main body 11 and the piston member 12 may be formed from any material, but the material must be selected in consideration of solvent resistance (e.g., resistance to swelling) depending upon kinds of the content in order to prevent dimensional changes, in consideration of barrier characteristic or drop strength in order to secure storability for the content, or in consideration of slipping characteristic of the piston member 12 and the main body 11 and flexibility of the scraping portion 12*b*. In general, they may be readily manufactured at a high precision by a molding method such as injection molding using a plastic material. The plastic material may be polypropylene (PP), high density polyethylene (HDPE), low density polyethylene (LDPE), polystyrene (PS), nylon (Ny), polyvinyl chloride (PVC), polyethylene terephthalate (PET), polycarbonate (PC), polyoxymethylene (POM), polysulfon (PSF), polyethersulfon (PES), polyacrylate (PAR), or polyamid (PA). Among these substances, a general-purpose plastic material such as PP, HDPE and LDPE is inexpensive and particularly preferable. PP and HDPE are preferably used for the scraping portion 12*b* which should be flexible. In this case, it is preferred that the outer diameter of the scraping portion 12*b* is set slightly larger than the inner diameter of the main body 11, so that when the piston member 12 is fitted to the main body 11, the scraping portion 12*b* is press-contacted to the inner wall of the main body 11 by virtue of its elasticity. Furthermore, these materials may be similarly employed for the following embodiments of the present invention.

Figure 15:
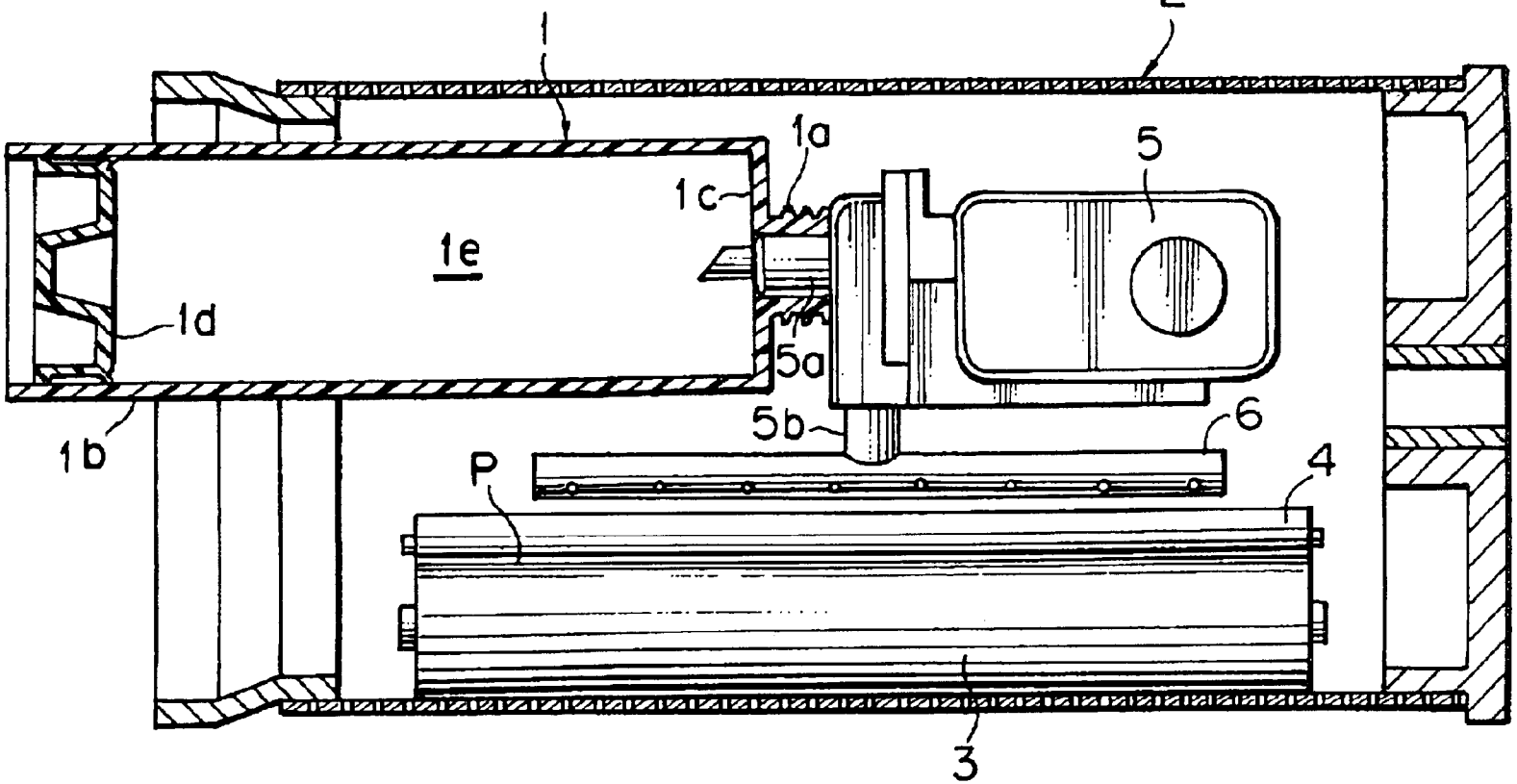
FIG. 15 PRIOR ART
FIG. 15 is a cross sectional view of an essential part of a stencil printing machine in which a conventional variable volume container is set.
Figure 16:
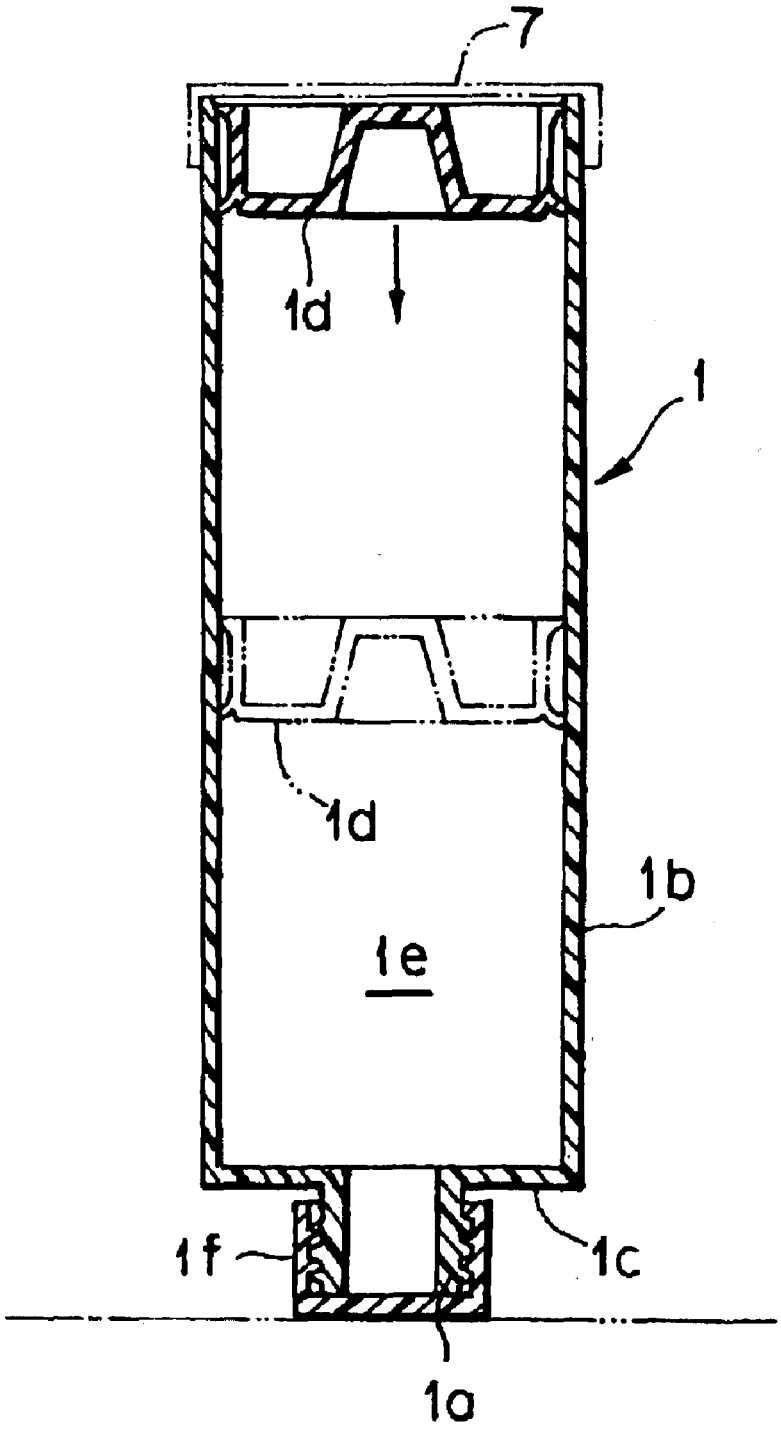
FIG. 16 PRIOR ART
FIG. 16 is a vertical sectional view of a conventional variable volume container.

In connection with FIG. 1, the function of the variable volume container 10 will be now described by referring to use of the container as a stencil printing ink container. In this case, the storage chamber 16 in the container 10 is filled with a high viscosity ink as the content. As the ink fills the storage chamber 16, as shown in FIG. 1, the piston member 12 is positioned at the open end portion of the main body 11 and the outlet 14 is sealed by the cap 15. The container is distributed in the market in this state as an ink cartridge. In use, the cap 15 is removed from the container 10. Then, the container 10 is set in the printing drum 2, and the outlet 14 is inserted in the suction conduit 5*a*, as shown in FIG. 15 similarly to the conventional case.

The container 10 is packaged or stored upside down in the distribution process with the outlet 14 facing the lower side as shown in FIG. 1. In this case, as the head 15*a* of the cap 15 serves as a supporting surface, the container 10 stands upright. In this moment, since the part 17 in which its thickness t gradually increases toward the outlet 14 is provided in the end wall 11*a* from which the outlet 14 projects, the thickness increasing part 17 provides impact resistance in the vertical direction. More specifically, the thickness increasing part 17 has a maximum strength at the outlet 14 where the former has the largest thickness, and thus the root portion of the outlet 14 is increased in strength by the thick part so that the root portion can be effectively protected against impact.

Therefore, even when the container 10 thus packaged is transported, unloaded or dropped by mistake, and subjected to resulting impact force, the outlet 14 can be prevented from being damaged. As a result, ink leakage from the main body 11 can be prevented, which improves its commercial value as an ink container in the market. Here, the thickness increasing part 17 according to the embodiment shown in FIG. 1 is formed by increasing the thickness of the end wall 11*a* on the outside surface of the container, but it should be understood that the thickness may be increased on the inside surface of the container or on both the inside and outside surfaces of the container.

Meanwhile, the materials of the main body 11 and the piston member 12 are selected in consideration of solvent resistance, barrier characteristic or drop strength, or slipping characteristic or flexibility and moldability, etc., as described above. Regarding the physical properties of the plastic material, the Izod impact value (JIS K7110: 23° C., notched test piece) should be appropriately 5 kJ/m$^2$ or more, preferably in the range from 7.5 to 15 (kJ/m$^2$). Emulsion ink which is a mixture of water and oil is often used as the stencil printing ink. Therefore, a plastic whose water absorption is 1% or less and whose physical properties exhibit high oil resistance against organic solvent or petroleum solvent is preferably used for the container for such ink. These physical property values are the same for water based ink or oil based ink. As a physical property value of PP suitable for injection molding, the melt flow rate (MFR) in accordance with JIS K7210 (230° C., test load: 21.2N) is preferably in a range from 5 to 50 g/10 min. These physical property values are similarly applied to the following embodiments of the invention.

Figure 2:
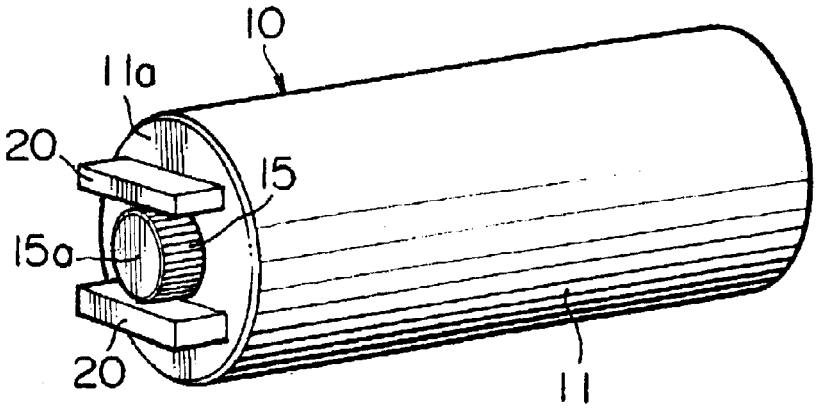
FIG. 2 is a perspective view of a variable volume container according to another embodiment of the present invention.
Figure 3:
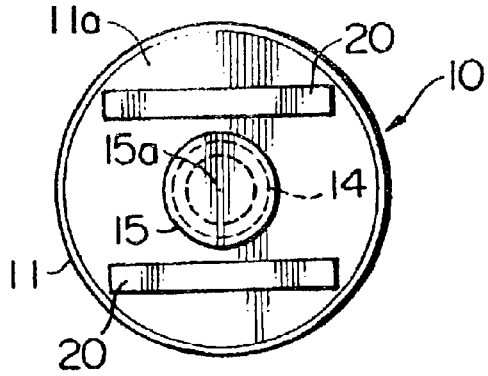
FIG. 3 is a front view of the variable volume container as shown in FIG. 2.
Figure 4:
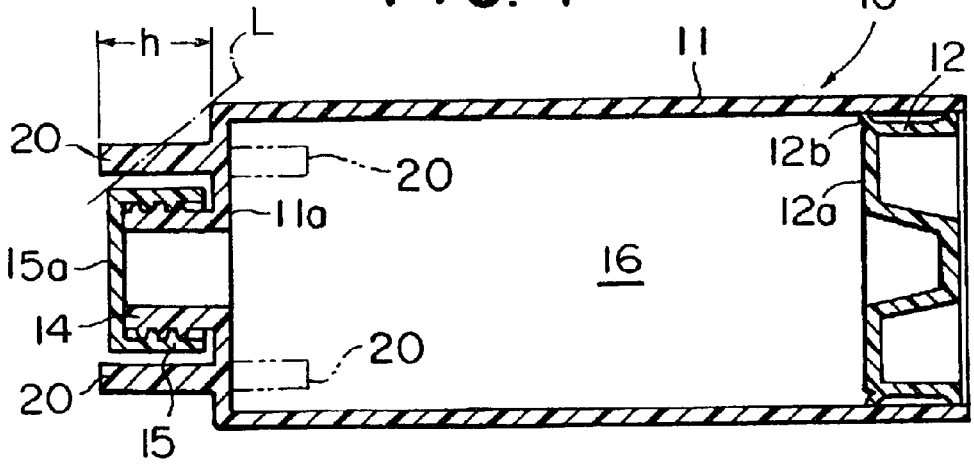
FIG. 4 is a vertical sectional view of the variable volume container as shown in FIG. 2.

FIGS. 2 to 4 show another embodiment, in which the same elements as those of the above described embodiment are denoted with the same reference characters and not detailed again. The variable volume container 10 according to the embodiment basically has the same structure as that of the variable volume container 10 according to the above described embodiment, but the end wall 11*a* according to this embodiment has a constant thickness unlike the above described embodiment.

In this embodiment, as shown in the perspective view of FIG. 2, a pair of rib shaped projections 20 are formed integrally to the outer surface of the end wall 11*a*, and they form an impact resisting reinforcement. As shown in the front view of FIG. 3, the pair of rib shaped projections 20 are provided symmetrically to one another around the outlet 14, and formed to be as long as possible on the end wall 11*a*. As shown in the vertical sectional view of FIG. 4, the projecting amount (height) h of each rib shaped projection 20 is beyond the line L connecting the periphery of the head of the cap 15 and the periphery of the end wall 11*a*. More specifically in the embodiment, the rib shaped projection 20 is formed to extend slightly beyond the surface of the head 15*a* of the cap 15.

Referring to FIGS. 2 to 4, the function of the variable volume container 10 will be now described. The container 10 has the rib shaped projections 20 provided at the end wall 11*a*, and thus the strength of the end wall 11*a* is increased in thickness-wise direction. As a result, the root portion of the outlet 14 projecting from the end wall 11*a* is reinforced. If impact is applied to the vicinity of the end wall 11*a* or outlet 14 of the container 10, the impact is distributed and the entire impact is not applied directly to the outlet 14, so that the outlet 14 is not damaged.

In this embodiment, the rib shaped projections 20 extend beyond the surface of the head 15*a* of the cap 15, and therefore the container 10 placed upside down is supported by the rib shaped projections 20, so that the outlet 14 can be prevented from being loaded by the container 10. A pair of such rib shaped projections 20 are provided symmetrically around the outlet 14, and thus the container 10 is supported stably on a region broader than the surface of the head 15*a* of the cap 15.

Note that in the embodiment shown in FIGS. 2 to 4, the rib shaped projection 20 extends beyond the surface of the head 15*a* of the cap 15, but the rib shaped projection 20 only has to project at least beyond the line L (refer to FIG. 4) connecting the periphery of the head 15*a* of the cap 15 and the outer periphery of the end wall 11*a* for the purpose of alleviating impact input to the outlet 14. In the embodiment shown in FIGS. 2 to 4, the rib shaped projection 20 is formed on the outer surface of the end wall 11*a*. However, for the purpose of reinforcing the end wall 11*a*, the rib shaped projections 20 may be formed only on the inside surface of the end wall 11*a*, or may be formed on both inside and outside surfaces of the end wall 11*a*.

Figure 5:
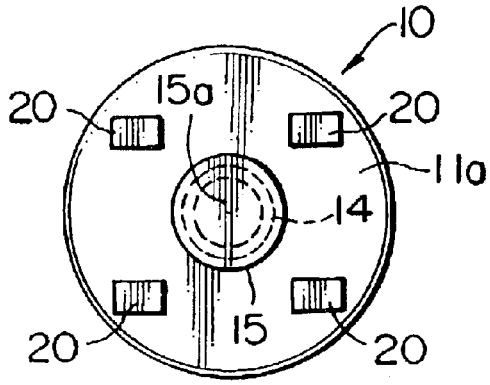
FIG. 5 is a front view of a variable volume container according to still another embodiment of the present invention.
Figure 6:
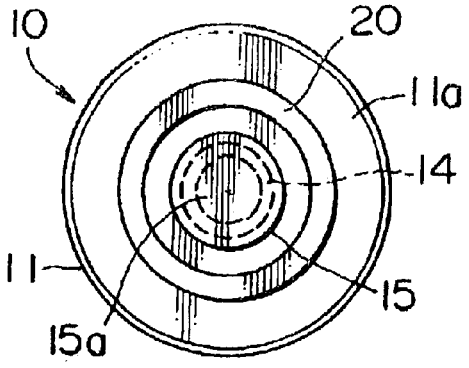
FIG. 6 is a front view of a variable volume container according to yet still another embodiment of the present invention.
Figure 7:
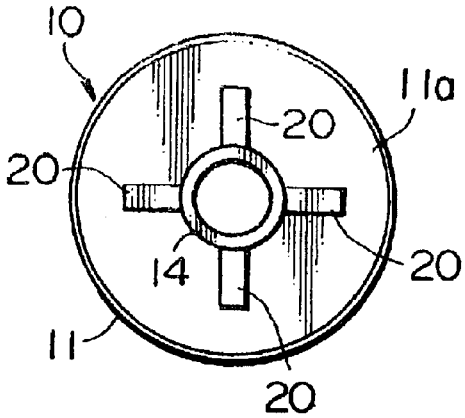
FIG. 7 is a front view of a variable volume container according to yet still another embodiment of the present invention.

FIGS. 5 to 7 show various modifications of the rib shaped projection, in which the same elements as those of the above described embodiments are denoted with the same reference characters and not detailed again. More specifically, the embodiment shown in FIG. 5 has four rib shaped projections 20 which are provided at the apexes of a foursquare around the outlet 14. In this embodiment, similarly to the embodiment shown in FIG. 4, if the height h of the rib shaped projection 20 extends outward beyond the surface of the head 15*a* of the cap 15, the container 10 placed upside down is stably supported by the four projections 20.

The embodiment shown in FIG. 6 has a rib shaped projection 20 which is annular and formed concentrically around the outlet 14 at an appropriate distance. In this embodiment, the end wall 11*a* is reinforced uniformly in the circumferential direction. Similarly to the embodiment shown in FIG. 4, if the height h of the rib shaped projection 20 extends outward beyond the surface of the head 15*a* of the cap 15, the container 10 placed upside down is extremely stably supported by the annular projection 20.

Furthermore, the embodiment of FIG. 7 has rib shaped projections 20 which are four members placed like a criss-cross with the outlet 14 in the center, and the surface of each projection 20 on the central side is in abutment against the outer periphery of the projecting part of the outlet 14. In this embodiment, the rib shaped projections 20 support the outer periphery of the projecting part of the outlet 14, and therefore the outlet 14 is prevented from deformation such as bending and buckling, and is also prevented from being damaged if impact is applied thereto. Note that in this embodiment, since the rib shaped projections 20 are in contact with the outer periphery of the projecting part of the outlet 14, the height of the rib shaped projections 20 should be just about the size not to interfere with the screw portion of the outlet 14. Alternatively, if the height is set higher than the outlet 14, a press-fit type cap member such as a cork plug to be sealingly press-fitted into the outlet 14 is preferably be used rather than the screw type cap 15 shown in FIG. 1.

It should be understood in the present invention that the shape or number of rib shaped projections 20 is not limited to that shown in FIGS. 5 to 7, and may be arbitrarily selected. Note however that as shown, the rib shaped projections 20 are preferably provided in a symmetrical manner around the outlet 14. It should be noted that those rib shaped projections 20 as shown in FIGS. 5 to 7 can alleviate impact input to the outlet 14 if they extend at least beyond the line L connecting the periphery of the head 15*a* of the cap 15 and the outer periphery of the end wall 11*a*. Otherwise, in order to simply reinforce the end wall 11*a*, the rib shaped projections may be provided on the outside surface, the inside surface, or both outside and inside surfaces of the end wall 11*a*.

The shape and number of rib shaped projections 20 may be different depending upon kinds of the content such as color of ink, while a detector which detects the shape and number of the rib shaped projections 20 may be provided in a device to which the container 10 is mounted such as the printing drum 2 (refer to FIG. 15). In this way, the kind of the content can be automatically determined at the moment when the container 10 is mounted.

Figure 8:
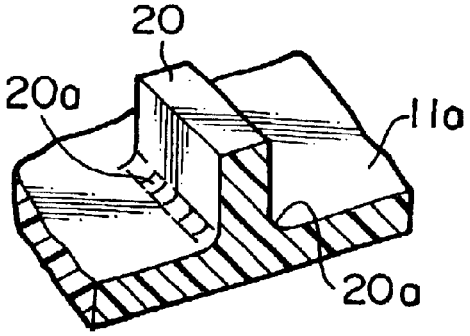
FIG. 8 is an expanded, perspective view of an essential part of a rib shaped projection provided in a variable volume container according to the present invention, showing a section thereof.

The rib shaped projection 20 is provided integrally to the end wall 11*a* as shown in FIG. 8, and at the time, the root portion of the rib shaped projection 20 is preferably broadened toward the end wall 11*a*. Particularly, the corner portions formed between the rib shaped projection 20 and the end wall 1la are preferably formed with circular arc surfaces 20*a*. By shaping the corner portions of the rib shaped projection 20 into rounded circular arc surfaces 20*a*, stress can be prevented from concentrating at the root portion of the rib shaped projection 20. Therefore, the effect of the rib shaped projection 20 to reinforce the end wall 11*a* can be further improved.

Figure 9:
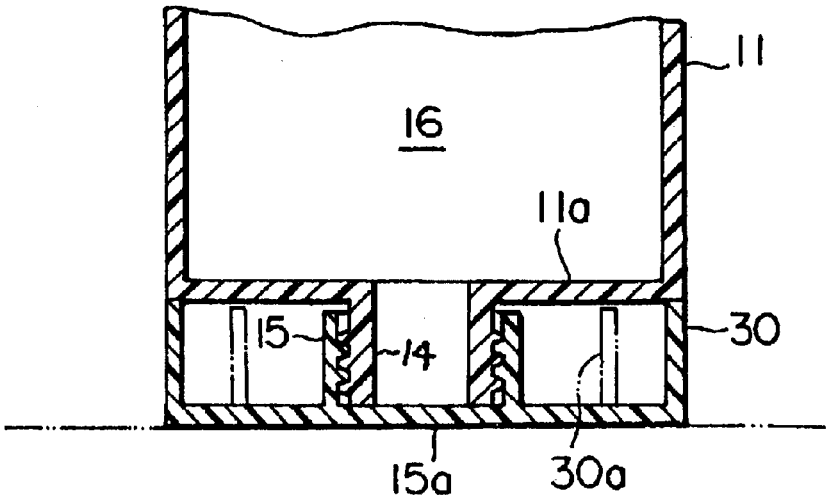
FIG. 9 is a vertical sectional view of an essential part of a variable volume container according to another embodiment of the present invention.

FIG. 9 shows still another embodiment of the present invention, in which the same elements are denoted by the same reference characters and not detailed again. FIG. 9 is a vertical sectional view of an essential part of the variable volume container 10 placed upside down. In this embodiment, the surface of the head 15*a* of the screwed cap 15 (or press-fit plug) mounted to the outlet 14 of the container 10 according to the foregoing embodiments is expanded to have the same diameter as that of the main body 11. In addition, a leg portion 30 extends from the circumferential part of the expanded head 15*a* and is in abutment against the end wall 11*a*. The leg portion 30 is formed to have a continuous annular shape, and abuts against the end wall 11*a* in its entire circumference.

Referring to FIG. 9, the function of the variable volume container 10 will be now described. The container 10 placed upside down is supported by the surface of the expanded head 15*a* of the cap 15, and therefore the container 10 is stably held. Any impact applied to the surface of the head 15*a* is allowed to escape through the leg portion 30 to the end wall 11*a*, and therefore impact applied to the outlet 14 can be alleviated to prevent damages at the outlet 14.

Herein, according to the embodiment, the surface of the head 15*a* is formed to have the same diameter as that of the main body 11, however the invention is by no means limited to this. The size of the head 15*a* can be selected as desired. It should be understood that a greater diameter of the head 15*a* allows the container 10 to be supported more stably. Another leg portion 30*a* may be provided on the surface of the head 15*a* as shown by the double dotted chain line in FIG. 9 in addition to the leg portion 30. This can further reduce impact applied to the outlet 14 because the impact input to the head 15*a* is more widely distributed. At this time, the leg portions 30, 30*a* do not have to have a continuous annular shape, but may be disconnected approximately at equal intervals in the circumferential direction. From the above, it is understood that the leg portions 30, 30*a* function as impact resisting reinforcements which are disposed at the end wall 11*a* according to the present invention.

Figure 10:
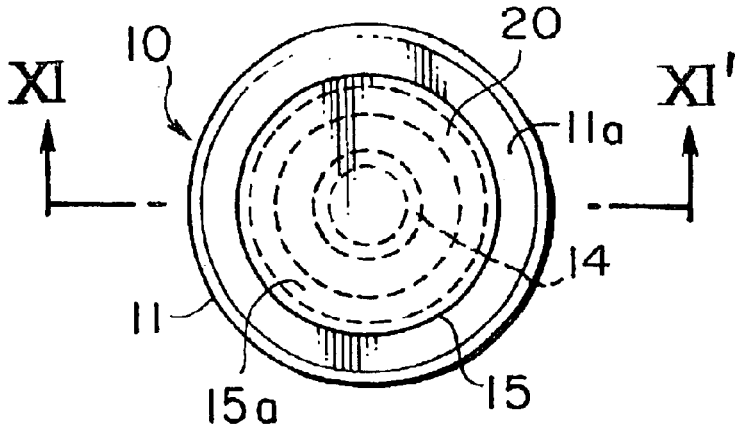
FIG. 10 is a front view of a variable volume container according to still another embodiment of the present invention.
Figure 11:
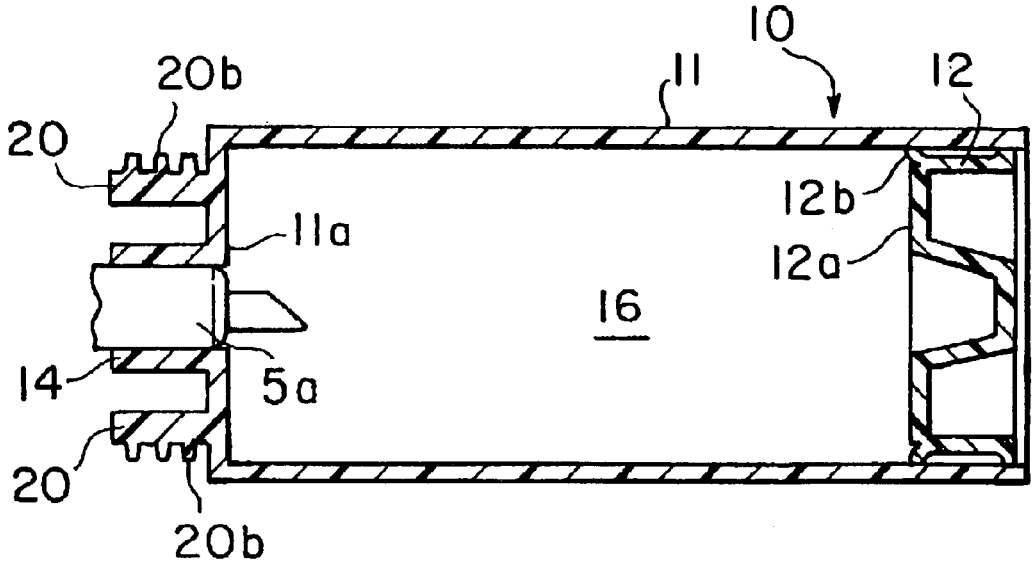
FIG. 11 is a vertical sectional view along the line XI–XI' of a variable volume container of FIG. 10, when installed in a stencil printing machine.

FIG. 10 and FIG. 11 show a variant of the embodiment shown in FIG. 6, in which the same elements are denoted by the same reference characters and not detailed again. The container 10 shown in FIG. 10 has the same structure as that of FIG. 6, except that the annular rib shaped projection 20 has a screw portion 20*b* on the outer circumferential surface thereof instead of that of the outlet 14 of FIG. 6, and a cap 15 as a cap member which is larger in size than that of FIG. 6 is detachably screwed to a screw portion 20*b*. Since the cap 15 of FIG. 10 has the head 15*a* larger in size than that of FIG. 6, the container 10 placed upside down is more stably supported by the head 15*a* of the cap 15 as well as the annular rib shaped projection 20. As shown in FIG. 11, the cap 15 is removed from the container 10, and the suction conduit 5*a* of the ink pump 5 is fitted in the outlet 14 in a manner similar to FIG. 15, when the container 11 is installed in the printing drum.

Figure 12A:
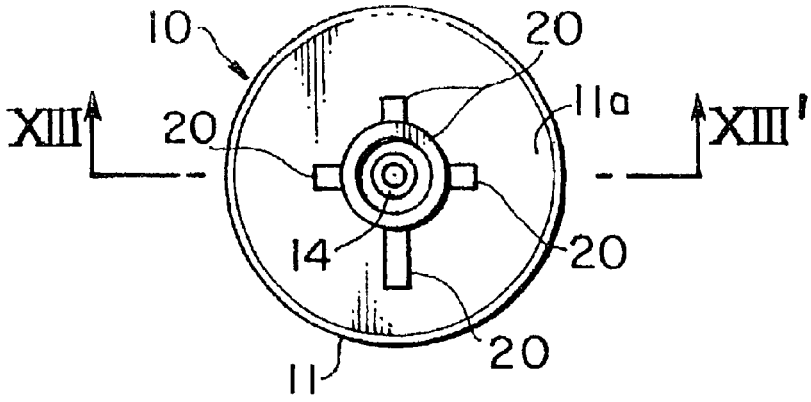
FIG. 12*a* and FIG. 12*b* are front views of variable volume containers according to yet still another embodiments of the present invention.

FIG. 12*a* shows a variant of the embodiment shown in FIG. 10 and FIG. 11, in which the same elements are denoted by the same reference characters and not detailed again. The container of FIG. 12*a* has a cylindrical outlet 14 which is smaller than that of FIG. 10 so that the container 10 can be suited to store and feed a liquid low in viscosity, particularly a low viscosity ink for stencil printing. The container 10 of FIG. 12*a* has a rib shaped projection 20 which is annular and formed concentrically around the outlet 14 at an appropriate distance. The annular rib shaped projection 20 of FIG. 12*a* is smaller than that of FIG. 10, and may have the same size as the outlet 14 of FIG. 10. As shown in FIG. 12*a*, the rib shaped projection 20 is further strengthened by additional ribs, for example, four members placed like a crisscross similarly to the embodiment of FIG. 7. It is needless to say that the container of FIG. 12*a* may be strengthened in accordance with other embodiments shown in FIG. 1 through FIG. 5.

Figure 12B:
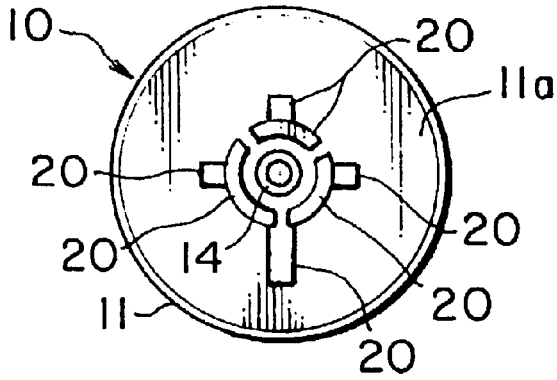

FIG. 12*b* shows a variant of the embodiment of FIG. 12*a*, in which the same elements are denoted by the same reference characters and not detailed again. While the container of FIG. 12*a* has a continuous annular rib shaped projection 20, the container of FIG. 12*b* has a discontinuous annular rib shaped projection 20. When the annular rib shaped projection 20 has the same size as the outlet 14 of FIG. 10 and has a screwed portion on the outer circumferential surface thereof in the embodiments of FIG. 12*a* and FIG. 12*b*, the same cap 15 as described with reference to FIG. 9 can advantageously be screwed to the screwed portion of the annular rib shaped projection 20 as shown in FIG. 13.

Figure 13:
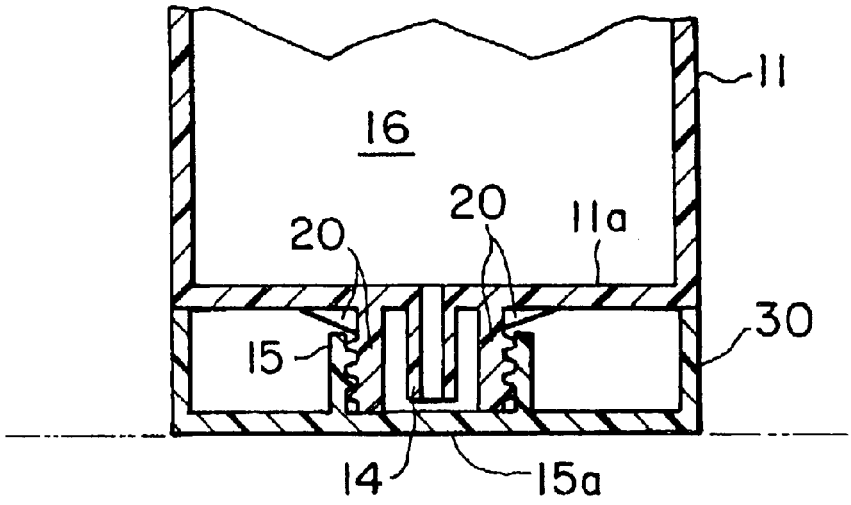
FIG. 13 is a vertical sectional view of an essential part of a variable volume container of FIG. 12*a* along the line XIII–XIII'.
Figure 14A:
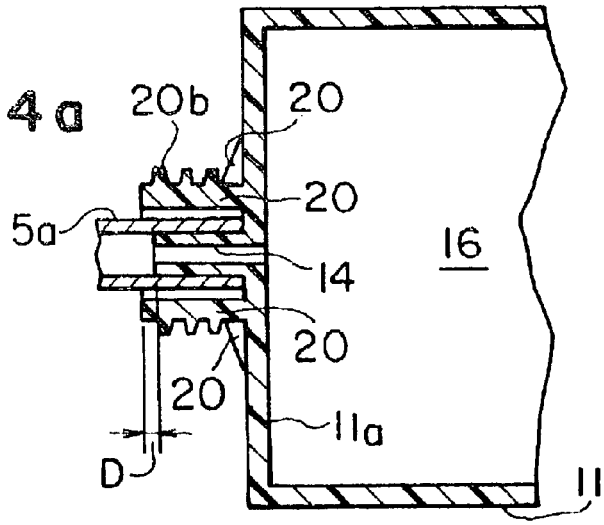
FIG. 14*a*, FIG. 14*b* and FIG. 14*c* are vertical sectional views of an essential part of a variable volume container of FIG. 12*a* along the line XIII–XIII', when installed in a stencil printing machine.
Figure 14B:
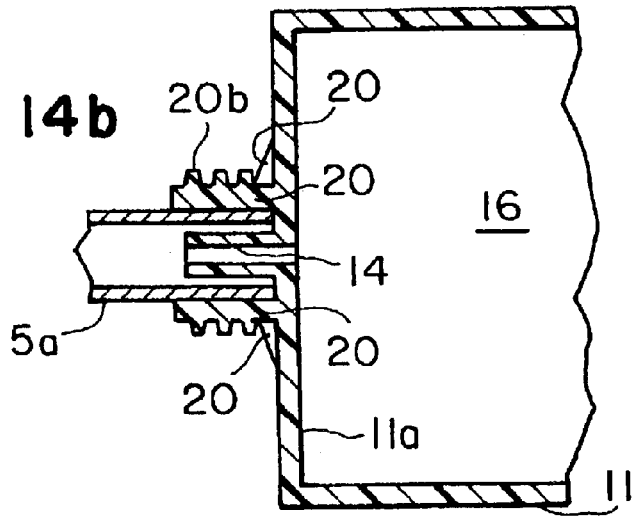
Figure 14C:
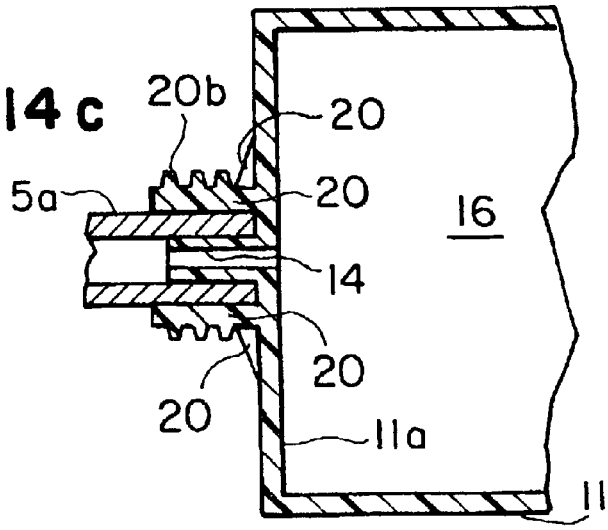

When the container shown in FIG. 12*a*, FIG. 12*b* or FIG. 13 is installed in the printing machine, it is preferred that a cylindrical suction conduit 5*a* of the ink pump is received in an annular groove that is formed between the annular rib shaped projection 20 and the cylindrical outlet 14 as shown in FIGS. 14*a* to 14*c*. In this case, there might be a fear that the outer circumferential surface of the outlet 14 is stained with ink when the container 10 is installed in or removed from the printing machine. However, since the annular rib shaped projection 20 can function as a bar to the ink, the ink is prevented from coming out of the annular projection 20 and staining the printing machine or operators' clothing. In this connection, it is preferred that the annular projection 20 extends from the outer surface of the end wall 11*a* longer than the outlet 14, and more concretely the distance D shown in FIG. 14*a* should be 5 mm or less. Of course, the annular projection 20 also functions as a member which protects the outlet 14. The suction conduit 5*a* may be coupled to the outlet 14 by engagement with the outer circumferential surface of the outlet 14 as shown in FIG. 14*a*, with the inner circumferential surface of the annular rib shaped projection 20 as shown in FIG. 14*b*, or with engagement with both the outer circumferential surface of the outlet 14 and the inner circumferential surface of the annular rib shaped projection 20 as shown in FIG. 14*c*.

As in the foregoing, in the variable volume container according to the present invention, an impact resisting reinforcement is additionally disposed at the end wall where the outlet is formed. Therefore, even if impact is applied to the vicinity of the outlet as the container is placed with the outlet facing the lower side, the outlet can be prevented from being damaged because of the impact resisting reinforcement provided in the vicinity of the root of the outlet. The present invention is also useful as a structure of a container that stores a liquid low in viscosity, particularly a low viscosity ink for stencil printing with protection of the outlet.

What is claimed is:

1. A stencil printing apparatus comprising a printing drum, a container that contains a stencil printing ink, said container comprising a cylindrical main body having an end wall at an end thereof; an outlet projecting from an outer surface of said end wall for allowing the stencil ink to be supplied; and a protecting member which is disposed on and projects directly from the outer surface of said end wall to surround said outlet and define a groove portion between said outlet and said protecting member for connection with a conduit, wherein said protecting member is a continuous or discontinuous annular projection and is longer than said outlet, and an ink pump which has a conduit coupled to the groove portion defined between said outlet and said protecting member, and wherein said conduit is (a) coupled to the groove portion by engaging an inner circumferential surface of the protecting member with an outer circumferential surface of the conduit, or (b) coupled to the groove portion by engaging an inner circumferential surface of the protecting member with an outer circumferential surface of the conduit, and by engaging an outer circumferential surface of the outlet with an inner circumferential surface of the conduit.

2. A stencil printing apparatus according to claim 1, in which said conduit is (a) coupled to the groove portion by engaging an inner circumferential surface of the protecting member with an outer circumferential surface of the conduit.

3. A stencil printing apparatus according to claim 1, in which said conduit is (b) coupled to the groove portion by engaging an inner circumferential surface of the protecting member with an outer circumferential surface of the conduit, and by engaging an outer circumferential surface of the outlet with an inner circumferential surface of the conduit.

4. The stencil printing apparatus according to claim 1, wherein said annular projection of said container extends longer by 5 mm or less than said outlet.

5. The stencil printing apparatus according to claim 1, wherein said container further comprises a cap member that can be unscrewed from and back onto the annular projection.

6. The stencil printing apparatus according to claim 1, wherein said containter further comprises a piston member fitted into said main body sealingly and slidably in an axial direction of said main body for defining a variable volume storage chamber between itself and said end wall.

7. A method for coupling a container for stencil printing ink to a printing apparatus having an ink pump with a conduit, which comprises providing a container comprising a cylindrical main body having an end wall at an end thereof; an outlet projecting from an outer surface of said end wall for allowing the stencil ink to be supplied; and a protecting member which is disposed on and projects directly from the outer surface of said end wall to surround said outlet and define a groove portion between said outlet and said protecting member for connection with said conduit, wherein said protecting member is a continuous or discontinuous annular projection and is longer than said outlet, and coupling said conduit to the groove portion defined between said outlet and said protecting member, wherein said conduit is (a) coupled to the groove portion by engaging an inner circumferential surface of the protecting member with an outer circumferential surface of the conduit, or (b) coupled to the groove portion by engaging an inner circumferential surface of the protecting member with an outer circumferential surface of the conduit, and by engaging an outer circumferential surface of the outlet with an inner circumferential surface of the conduit.

8. A method according to claim 7, in which said conduit is (a) coupled to the groove portion by engaging an inner circumferential surface of the protecting member with an outer circumferential surface of the conduit.

9. A method according to claim 7, in which said conduit is (b) coupled to the groove portion by engaging an inner circumferential surface of the protecting member with an outer circumferential surface of the conduit, and by engaging an outer circumferential surface of the outlet with an inner circumferential surface of the conduit.

10. A container and a pump combination comprising:

a container comprising:

a cylindrical main body having an end wall at an end thereof;

an outlet projecting from an outer surface of said end wall for allowing a content to be supplied; and a protecting member which is disposed on the outer surface of said end wall to surround said outlet and define a groove portion between said outlet and said protecting member for connection with a conduit, wherein said protecting member is a continuous or discontinuous annular projection which projects directly from said outer surface of said end wall longer than said outlet; and a pump having a conduit, wherein said annular projection has an inner circumferential surface that engages with the outer circumferential surface of a conduit of a pump that can suck a content from the container, and wherein said outlet has an outer circumferential surface that engages with an inner circumferential surface of a conduit of a pump that can suck a content from the container.

* * * * *